US006308998B1

(12) United States Patent
Armbruster et al.

(10) Patent No.: US 6,308,998 B1
(45) Date of Patent: Oct. 30, 2001

(54) MOTOR VEHICLE DOOR LOCK WITH LOCKING ELEMENTS

(75) Inventors: Stefan Armbruster, Heiligenhaus; Johannes-Theodor Menke, Velbert; Thomas Schönenberg, Leverkusen, all of (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/368,827

(22) Filed: Aug. 5, 1999

(30) Foreign Application Priority Data

Sep. 16, 1998 (DE) ..... 198 42 358

(51) Int. Cl.[7] ..... E05B 3/00

(52) U.S. Cl. ..... 292/348; 292/DIG. 60; 74/522; 74/543

(58) Field of Search ..... 292/216, 336.3, 292/348, DIG. 60; 74/522, 543, 546, 105

(56) References Cited

U.S. PATENT DOCUMENTS 2,832,626 * 4/1958 Priestman ..... 292/280
2,989,333 * 6/1961 Fox ..... 292/280
3,848,909 * 11/1974 Foley ..... 292/216
4,577,608 * 3/1986 Dubois ..... 123/583
5,069,493 * 12/1991 Mochida ..... 292/336.3
5,431,462 * 7/1995 Lignell ..... 292/336.3
5,584,516 * 12/1996 Cetnar ..... 292/336.3

FOREIGN PATENT DOCUMENTS 44 43 969 6/1995 (DE) .

* cited by examiner

*Primary Examiner*—Gary Estremsky

(57) ABSTRACT

A motor-vehicle door holding a lock provided with actuating elements operable to lock the door has an actuating system having an outside opening handle displaceable on the door, a pivot on the door, a first compensating lever pivotable on the pivot and having an outer end forming a seat, and a first rod part having an outer end connected to the handle and an inner end bearing on the seat in a predetermined direction. A second rod part having an outer end connected to the lock actuating elements and an inner end connected to an outer end of a second compensating lever pivotable on the pivot. A spring braced between the levers urges their outer ends angularly apart with the outer end of the first compensating lever bearing against the predetermined direction on the first rod-part inner end. A screw engaged between the levers offset from the pivot can releasably fix the levers together for joint pivoting. This screw is loosenable for relative pivoting of the levers.

5 Claims, 4 Drawing Sheets

MOTOR VEHICLE DOOR LOCK WITH LOCKING ELEMENTS

FIELD OF THE INVENTION

The invention relates to a motor vehicle door lock with locking elements, an actuation lever system acting on the locking elements, an outside opening handle for external actuation of the actuation lever system and an outside actuation rod acting on the actuation lever system.

BACKGROUND OF THE INVENTION

The locking elements are conventionally a rotary latch fork, a pawl and a release lever. The outside opening handle acts on the release lever via the outside actuation rod and the actuation lever system so that the latch and hence the motor vehicle door lock are opened. Interlocking elements are usually provided in addition to the locking elements and actuation elements. In a motor vehicle door lock of this kind it is conventional to combine the locking elements and the interlocking lever system and the actuation lever system in a structural unit forming a function submodule. The outside opening handle can be constructed in the form of a flap-type handle disposed in a handle cup usually mounted on a base plate and forming an outside actuation submodule therewith. The outside actuation submodule can also comprise a lock cylinder.

The outside actuation submodule and the function submodule are usually arranged with vertical spacing in the installed state in a motor vehicle door. Thus the outside actuation rod acting between the outside actuation submodule and the function submodule is disposed substantially vertically in the door. Since in the course of assembly tolerances occur in the vertical direction, in one motor vehicle door lock known in practice a clamping device is used for the purpose of length compensation.

The clamping device is pivotally connected to an arm of the deflection lever connected to the handle cup. The outside actuation rod is pushed into the clamping device so as to be freely displaceable. When the motor vehicle door lock is inserted into the motor vehicle door, the fitter closes the clamping device and thus makes a rigid connection between the arm of the deflection lever and the outside actuation rod.

In a modern vehicle door lock it is also conventional for the outside actuation handle to be preassembled with the base plate and the door lock on a carrier plate which after its installation into the vehicle door separates the wet and dry areas. However, a problem which arises as a result is that the clamping device is practically no longer accessible from the exterior and it is no longer possible to obtain a satisfactory and simple tolerance compensation between the outside opening handle and the outside actuation rod in the course of assembly.

An outside actuation system for a motor vehicle door lock is also known which comprises a pull handle mounted to pivot by an end zone about a vertical pivot fixed to the door, the other end of the system being arranged for pivotal connection of an actuation rod f or a pivotable opening lever of the door lock. In order to avoid the need for assembly operations from the inside of the door, the opening lever is provided with a pivotable clamping seat for the actuation rod (cf. DE 44 43 969).

OBJECT OF THE INVENTION

The technical problem underlying the invention is to provide a motor vehicle door lock of the type described in the preamble, in which satisfactory and also simple tolerance compensation is possible in respect of the outside actuation rod during the lock assembly.

SUMMARY OF THE INVENTION

This technical problem is solved by a motor vehicle door lock with locking elements, an actuation lever system acting on the locking elements, an outside opening handle for external actuation of the actuation lever system and an outside actuation rod acting on the actuation lever system. According to the invention the outside actuation rod is constructed in the form of a divided outside actuation rod consisting of at least one first rod part and a second rod part. The first rod part and the second rod part are adapted to be interconnected via a compensating device which comprises a first compensating lever adapted to be connected to the first rod part and a second compensating lever adapted to be connected to the second rod part. The first compensating lever and the second compensating lever are pivotable and/or displaceable relative to one another and, in the course of assembly, after tolerance compensation has been effected, are adapted to be fixed together by means of a tool introducible into the door from outside.

As a result, length compensation is still possible as it was previously, since the two rod parts are displaceable relative to one another by means of the compensating device. Since the outside actuation rod is in the form of a divided outside actuation rod and the compensating device is disposed between the two rod parts, according to the teaching of the invention it is possible to obtain length tolerance compensation in the outside actuation rod in a very simple manner and this also applies to assembly, particularly since the outside actuation rod is constructed as a divided outside actuation rod and a compensating device serves as an adjustable connecting device between the two rod parts. Thus according to the invention, the first compensating lever and the second compensating lever are adapted to be fixed together by means of the tool through an entry opening disposed in the end face plate of the motor vehicle door. The compensating device is freely accessible even if a carrier plate is provided to separate the wet and dry areas.

In one preferred embodiment of the invention, the first compensating lever and the second compensating lever are mounted to pivot about a common pivot. This pivot can, for example, be disposed on an adapter element which connects the outside actuation submodule to the function submodule. According to another feature, the first compensating lever and the second compensating lever are pivotable relatively to one another against the action of a spring or the like. In this way very simple tolerance compensation is possible during assembly. For example, the two legs of a hairpin spring press the two compensating levers apart so that the two rod parts connected to the compensating levers have a common maximum total length. During assembly, it is then possible to press the two rod parts toward each other against the force of the spring by way of the two compensating levers and thus adjust the required functional length of the two rod parts. The two compensating levers are then fixed together in the required position so that relative movement between the two levers is no longer possible. Nevertheless, the two compensating levers which act like a single compensating lever are pivotable about the common pivot. Thus the movement of the first rod part causes a common pivoting movement of the two compensating levers so that the second rod part is displaced to act on the actuating elements of the function submodule.

Advantageously, the first rod part at its end facing the second rod part has a connection head which acts on a connection surface or seat of the first compensating lever. According to another feature of the invention the second rod part at its inner end near the first rod part is positively connected to the second compensating lever. This can be achieved, for example, by the first rod part being bent into an eye at its end and engaging through an opening in the first compensating lever. Thus while the second rod part extends rigidly between the second compensating lever and the function submodule, the first rod part can be inserted during assembly of the handle cup and be fitted by its connection head to the connection surface or seat of the first compensating lever. This is a very simple and yet economic method of obtaining length tolerance compensation of the outside actuation rod during assembly of the handle cup.

The compensating device has for fixing purposes an actuation screw which extends through the second compensating lever via an arcuate slot and engages in a screwthread disposed in the first compensating lever and is adapted to be tightened against the second compensating lever. Thus the first compensating lever can be fixed with the second compensating lever in the required position in a simple manner by means of a tool, for example a screwdriver, and then be released if required. Basically, however, other fixing means are possible, e.g. a catch connection.

BRIEF DESCRIPTION OF THE DRAWING

The invention is explained in detail below with reference to a drawing which simply illustrates one exemplified embodiment and wherein.

SPECIFIC DESCRIPTION

Figure 1:
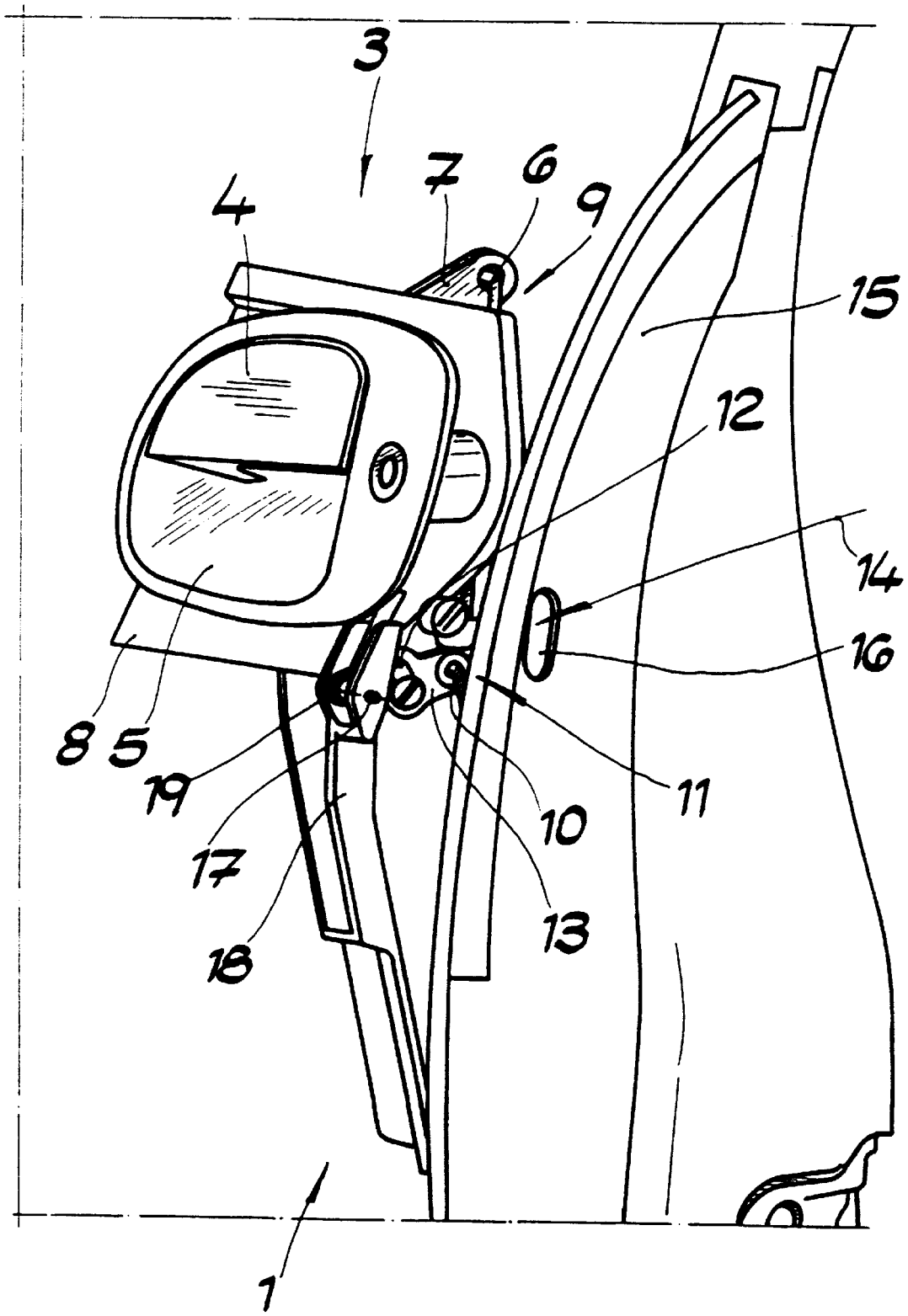
FIG. 1 is a diagrammatic and perspective view of a motor vehicle door lock inserted in a motor vehicle door looking at the door edge face plate.

The drawings show a motor vehicle door lock 1. The locking elements, which conventionally comprise a rotary latch fork, a pawl and a release lever, and the actuating lever system acting on the locking elements are combined in a function submodule 2. It will be apparent from FIG. 1 that the motor vehicle door lock 1 comprises an outside actuation submodule 3 with an outside opening handle 4 mounted in a handle cup 5. The outside opening handle 4 serves for external actuation of the actuation lever system via a substantially vertical outside actuating rod 6 acting on the actuation lever system. The outside opening handle 4 is a flap-type handle connected to an arm 7 on which the outside actuation rod 6 is articulated. The outside opening handle 4 is disposed on a base plate 8 together with the handle cup 5.

It will be apparent from the drawings that the outside actuation rod 6 is formed as a divided outside actuation rod 6 consisting of at least one first rod part 9 and a second rod part 10. The first rod part 9 and the second rod part 10 are interconnected at inner ends via a compensating device 11. The latter comprises a first compensating lever 12 connected to the first rod part 9 and a second compensating lever 13 connected to the second rod part 10. The first compensating lever 12 and the second compensating lever 13 are pivotable relatively to one another and during the course of assembly are adapted to be fixed together by a tool 14 which can be introduced into the door from outside. It will be particularly clear from FIG. 1 that the first compensating lever 12 and the second compensating lever 13 can be fixed together by means of the tool 14 through an entry opening 16 disposed in the edge face plate 15 of the motor vehicle door.

Figure 2:
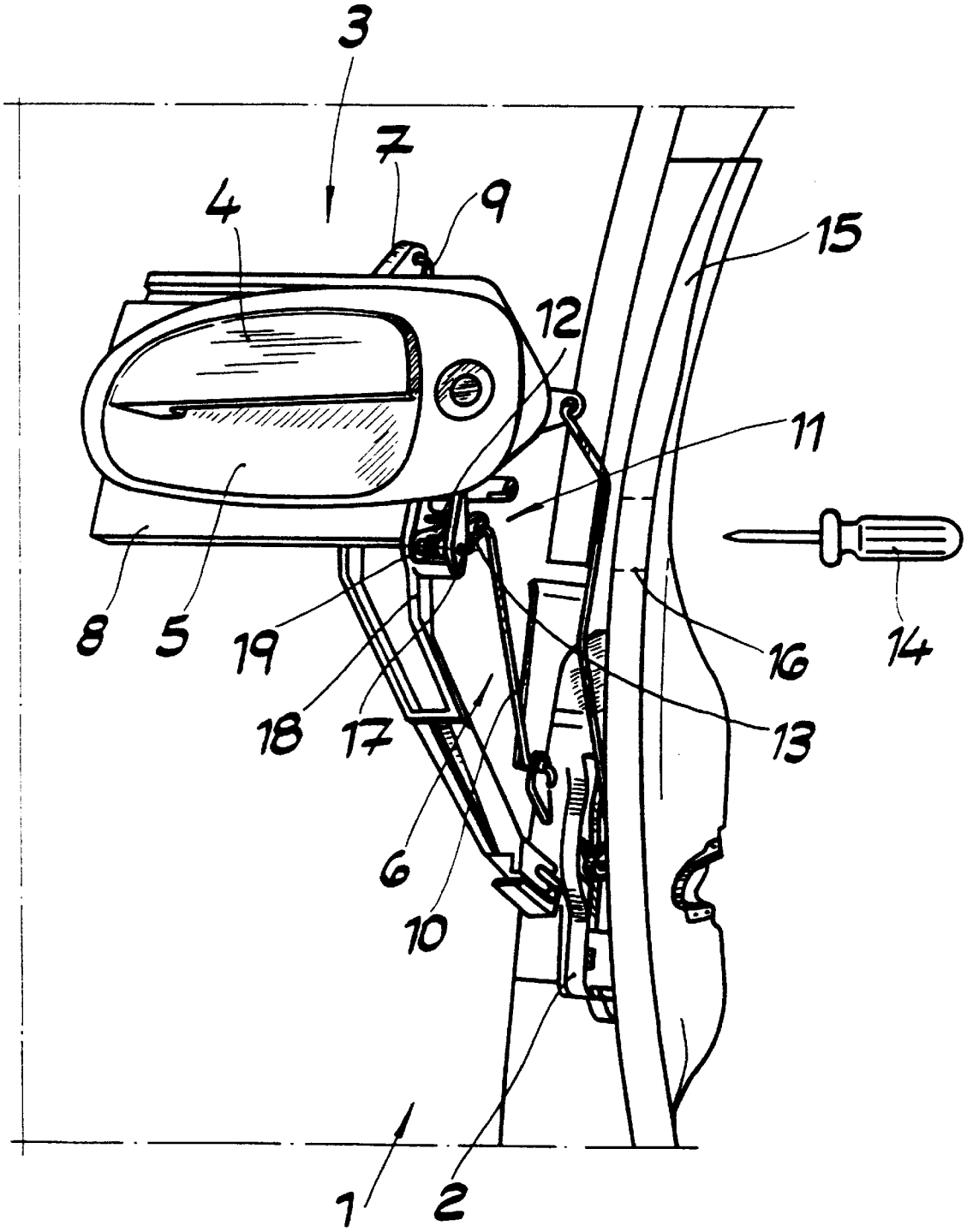
FIG. 2 is a side elevation of the subject shown in FIG. 1.
Figure 3:
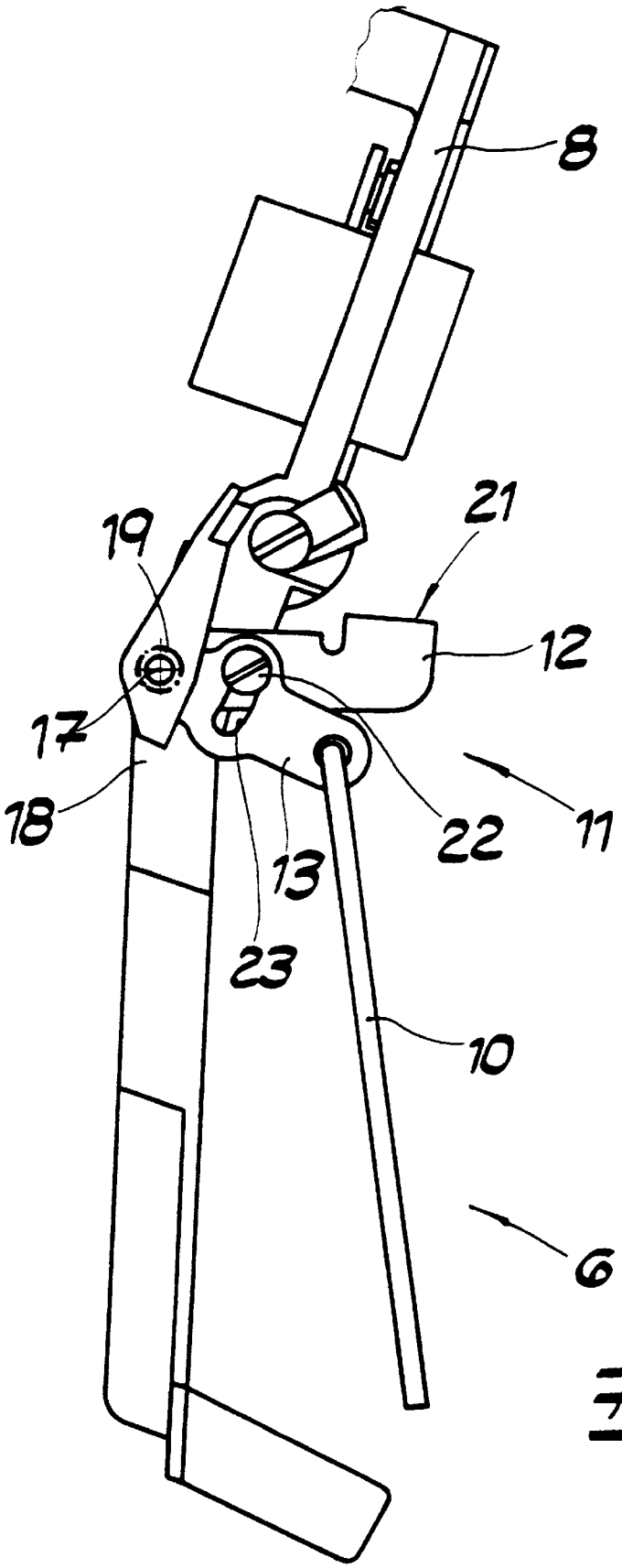
FIG. 3 is a motor vehicle door lock according to the invention in end elevation in the preassembled state.
Figure 4:
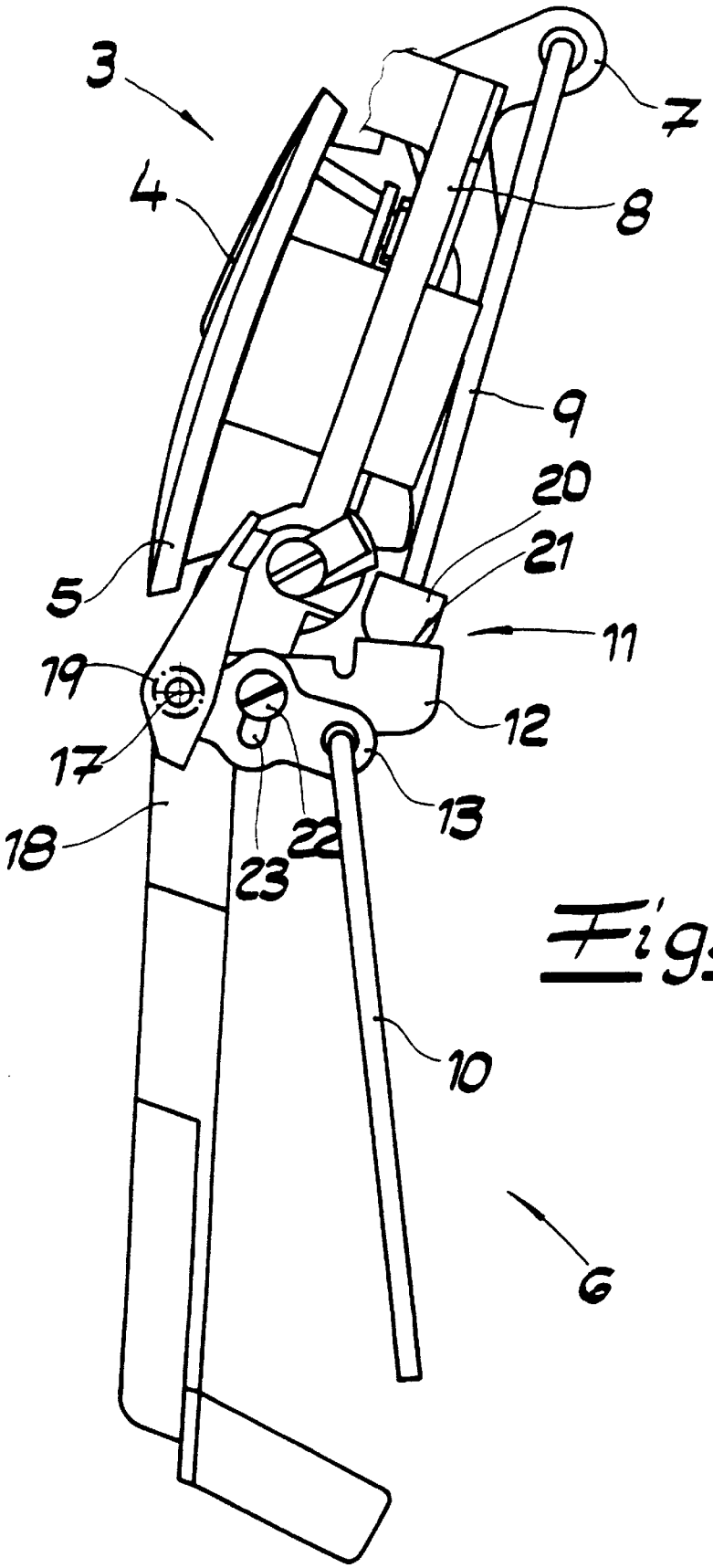
FIG. 4 is an end elevation of a motor vehicle door lock in the finally assembled state.

FIGS. 3 and 4 show that the first compensating lever 12 and the second compensating lever 13 are mounted for pivoting about a common pivot 17 carried on an adapter element 18 disposed between the outside actuation submodule 3 and the function submodule 2. This will be clear particularly from FIG. 2. The first compensating lever 12 and the second compensating lever 13 are pivotable relative to one another against the action of a spring 19. At its inner end near the second rod part 10, the first rod part 9 comprises a connection head 20 that bears on a connection surface or seat 21 of the first compensating lever 12. At its inner end near the first rod part 9, the second rod part 10 is positively connected to the second compensating lever 13. It will also be seen from FIGS. 3 and 4 that the compensating device 11 has an actuation screw 22 for fixing purposes. This screw 22 passes through the second compensating lever 13 through an arcuate slot 23 and engages in a screwthread disposed in the first compensating lever 12.

Assembly of the motor vehicle door lock 1 according to the invention and the accompanying tolerance compensation by means of the outside actuation rod 6 will be particularly seen from a comparison of FIGS. 3 and 4. FIG. 3 shows the adapter element 18 first inserted into the vehicle door, the element 18 being connected to the function submodule 2, the base plate 8 being connected to its top end. The compensating device 11 is also disposed at the top end of the adapter element 18. The second rod part 10 is inserted in this state between the second compensating lever 13 and the function submodule 2, which is not shown in FIG. 3. The spring 19 disposed in the compensating device 11 presses the two compensating levers 12 and 13 apart at this stage of assembly. In this condition the actuation screw 22 which engages the screwthread of the first compensating lever 12 through the arcuate slot 23 in the second compensating lever 13 is released. In the course of assembly of the handle cup 5, the latter together with the outside opening handle 4 and the first rod part 9 connected thereto is fitted on the base plate 8. This will be apparent from a comparison of FIGS. 3 and 4. The first rod part 9 is placed with its connection head 20 connected thereto on a seat or connection surface 21 of the first compensating lever 12. In this condition the lever 12 is pressed against the second compensating lever 13 and pivoted against the force of the spring 19. Thus tolerance compensation already takes place as a result of insertion of the first rod part 9. As soon as the first rod part 9 has been inserted, the actuation screw 22 is tightened by the tool 14 so that the first compensating lever 12 is fixed to the second compensating lever 13. The two compensating levers 12 and 13 then act as a single connection lever which is pivotable about the pivot 17 and transmits the translators movement of the first rod part 9 to the second rod part 10.

What is claimed is:

1. In a motor-vehicle door holding a lock provided with actuating elements operable to lock the door, an actuating system comprising:

an outside opening handle displaceable on the door;

a pivot on the door;

a first compensating lever pivotable on the pivot and having an outer end forming a seat;

a first rod part having an outer end connected to the handle and an inner end bearing on the seat in a predetermined direction;

a second rod part having an outer end connected to the lock actuating elements and an inner end;

a second compensating lever pivotable on the pivot and having an outer end connected to the inner end of the second rod part;

means including a spring braced between the levers for urging the outer ends thereof angularly apart with the outer end oE the first compensating lever bearing against the predetermined direction on the first rod-part inner end; and means accessible from outside the door for releasably fixing the levers together for joint pivoting, the fixing means being loosenable for relative pivoting of the levers.

2. The motor-vehicle door actuating system defined in claim 1 wherein the door has an edge plate formed with an opening adapted to pass a tool for operating the fixing means.

3. The motor-vehicle door actuating system defined in claim 1 wherein the inner end of the second rod part is positively connected to the outer end of the second compensating lever.

4. The motor-vehicle door actuating system defined in claim 3 wherein the inner end of the second rod part is hooked through the outer end of the second compensating lever.

5. The motor-vehicle door actuating system defined in claim 1 wherein the fixing means is a screw threaded into one of the levers offset from the pivot and having a head capable of pressing the other of the levers against the one lever.

* * * * *